US009089744B2

(12) United States Patent
Lo

(10) Patent No.: US 9,089,744 B2
(45) Date of Patent: Jul. 28, 2015

(54) INFLATABLE SPORTS BALL HAVING A WOVEN OUTER LAYER

(71) Applicant: Chien-Chuan Lo, Hua-Lien Hsien (TW)

(72) Inventor: Chien-Chuan Lo, Hua-Lien Hsien (TW)

( * ) Notice: Subject to any disclaimer, the term of this patent is extended or adjusted under 35 U.S.C. 154(b) by 68 days.

(21) Appl. No.: 13/962,186

(22) Filed: Aug. 8, 2013

(65) Prior Publication Data

US 2015/0045160 A1 Feb. 12, 2015

(51) Int. Cl.
*A63B 41/10* (2006.01)
*A63B 41/08* (2006.01)

(52) U.S. Cl.
CPC *A63B 41/10* (2013.01); *A63B 41/08* (2013.01)

(58) Field of Classification Search
CPC ..... A63B 43/005; A63B 43/02; A63B 41/08; A63B 69/002; A63B 41/10
USPC ..... 473/596, 597, 599, 603–606
See application file for complete search history.

(56) References Cited

U.S. PATENT DOCUMENTS

| | | | | | |
|---|---|---|---|---|---|
| 1,559,117 | A * | 10/1925 | Maynard | 473/596 |
| 2,011,760 | A * | 8/1935 | Gallinant | 473/596 |
| 2,194,674 | A * | 3/1940 | Riddell | 473/597 |
| 2,448,731 | A * | 9/1948 | Park | 473/596 |
| 5,183,263 | A * | 2/1993 | Kuebler | 473/573 |
| 5,195,745 | A * | 3/1993 | Rudell et al. | 473/573 |
| 5,316,294 | A * | 5/1994 | Turangan | 473/573 |
| 5,451,046 | A * | 9/1995 | Batton | 473/470 |
| 5,570,882 | A * | 11/1996 | Horkan | 473/438 |
| 5,851,161 | A * | 12/1998 | Sassak | 473/596 |
| 6,722,889 | B1 * | 4/2004 | Page et al. | 434/251 |
| D505,462 | S * | 5/2005 | Horkan et al. | D21/712 |
| D505,463 | S * | 5/2005 | Horkan et al. | D21/712 |
| 7,029,407 | B2 * | 4/2006 | Lee et al. | 473/597 |
| 8,460,135 | B2 * | 6/2013 | Guenther et al. | 473/597 |
| 2005/0075197 | A1 * | 4/2005 | Horkan | 473/438 |
| 2008/0176685 | A1 * | 7/2008 | Madore et al. | 473/599 |

* cited by examiner

*Primary Examiner* — Steven Wong
(74) *Attorney, Agent, or Firm* — Pepper Hamilton LLP

(57) ABSTRACT

An inflatable sports ball includes an inner layer and an outer layer. The inner layer includes a bladder that defines an air chamber, and a valve that is mounted to the bladder and that is in fluid communication with the air chamber. The outer layer includes a casing that surrounds the bladder, and an inflation inlet that is formed in the casing and that is in fluid communication with the valve. The casing includes a plurality of panels stitched to each other, and a plurality of fabrics woven to at least one of the panels in such a manner that the fabrics project from an outer surface of the at least one of the panels.

2 Claims, 5 Drawing Sheets

INFLATABLE SPORTS BALL HAVING A WOVEN OUTER LAYER

BACKGROUND OF THE INVENTION

1. Field of the Invention

This invention relates to a sports ball, and more particularly to an inflatable sports ball having a woven outer layer.

2. Description of the Related Art

A conventional inflatable sports ball includes a casing formed with an inflation inlet, and a bladder surrounded by the casing and embedded with a valve in fluid communication with the inflation inlet in the casing. The casing has a ball body that may be spherical (such as volleyball) or of an irregular shape (such as football).

To provide different outer appearances of sports balls, a sports ball may be printed or pressed to form a pattern. In this manner, the sports ball can be customized easily. However, the pattern is apt to be peeled off or discolored due to frequent contact with fingers, changes in weather, or use for a long period time. To solve this problem, the casing of a sports ball is formed from a plurality of panels 91 (see FIG. 1) having different shapes. Or, the casing is formed from a plurality of panels 92 (see FIG. 2) made of different materials. Such sports balls are easy to be damaged, and are difficult to catch during use.

SUMMARY OF THE INVENTION

The object of this invention is to provide a durable sports ball that is easy to catch during use.

According to this invention, there is provided an inflatable sports ball comprising:

an inner layer including a bladder that defines an air chamber, and a valve that is mounted to the bladder and that is in fluid communication with the air chamber; and an outer layer including a casing that surrounds the bladder, and an inflation inlet that is formed in the casing and that is in fluid communication with the valve, the casing including a plurality of panels stitched to each other, and a plurality of fabrics woven to at least one of the panels in such a manner that the fabrics project from an outer surface of the at least one of the panels.

The fabrics can be used for a longer time period than a printed or pressed pattern, so that the sports ball is more durable. Furthermore, since the fabrics project from the outer surface of the at least one of the panels, it is easy to catch during use.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
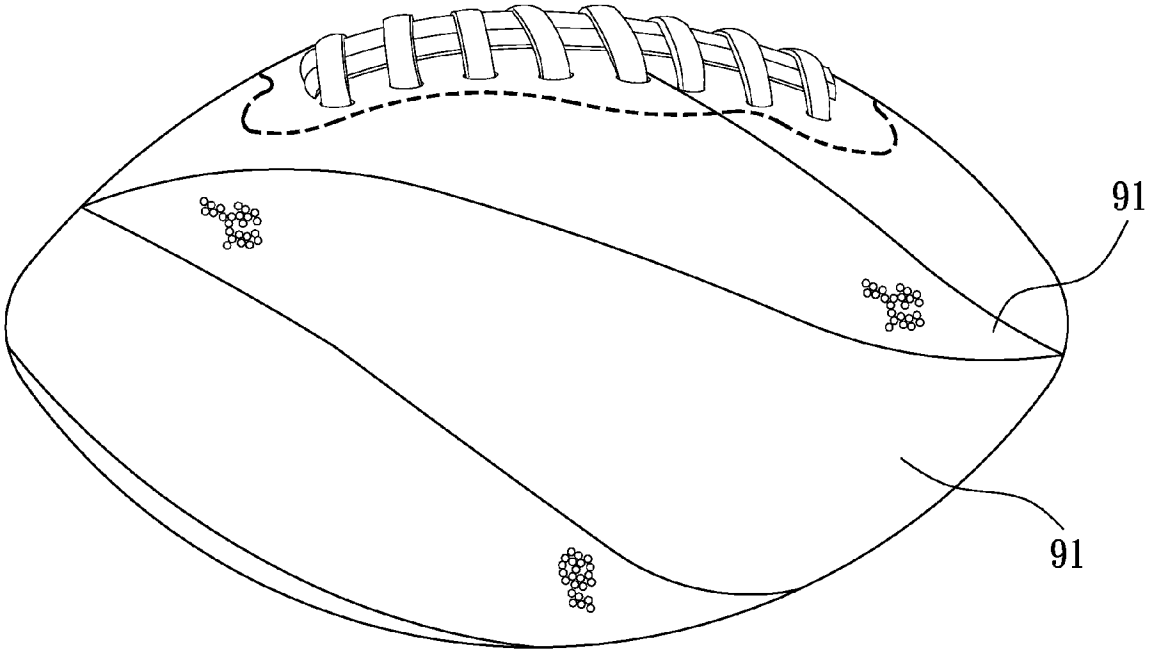
FIG. 1 PRIOR ART
FIG. 1 is a perspective view of a conventional inflatable sports ball.
Figure 2:
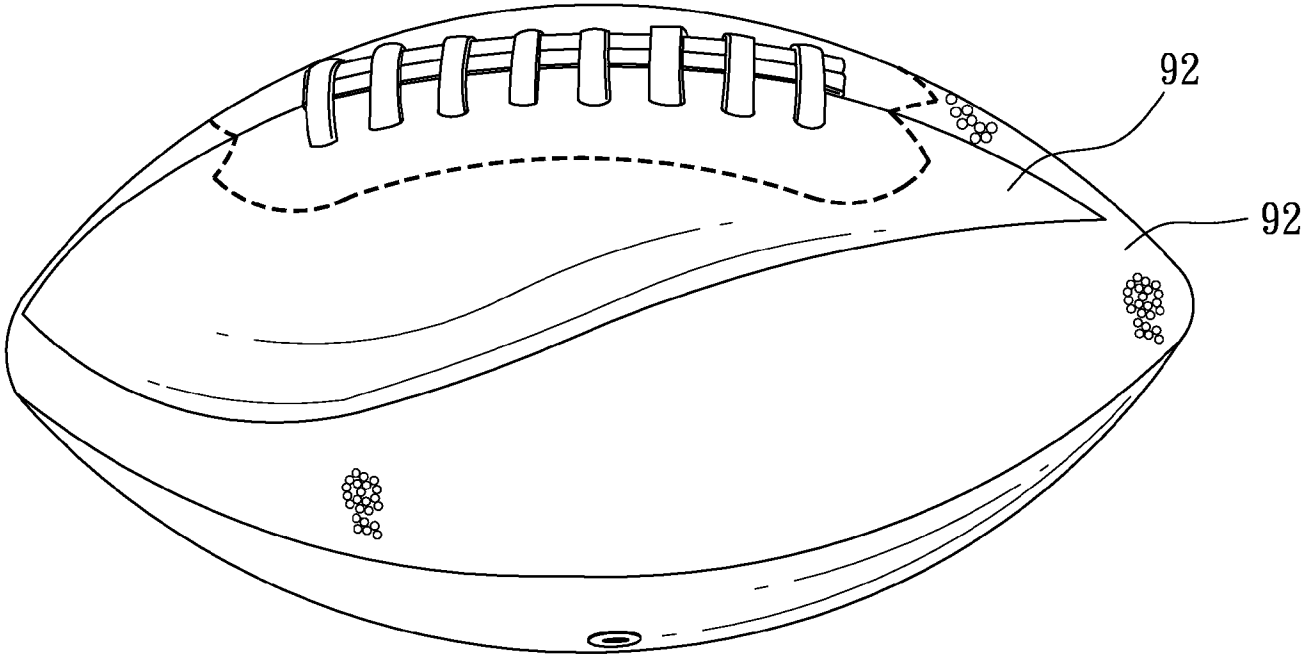
FIG. 2 PRIOR ART
FIG. 2 is a perspective view of another conventional inflatable sports ball.
Figure 3:
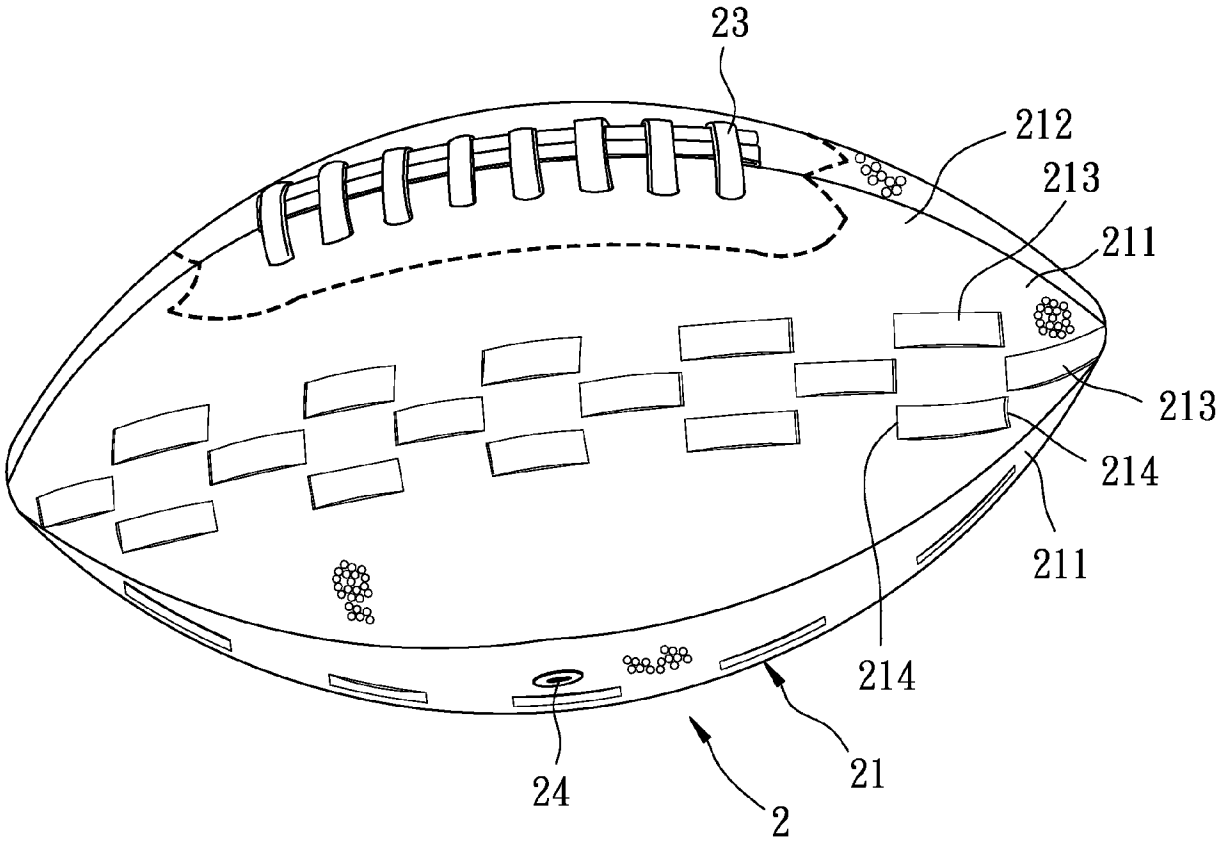
FIG. 3 is a perspective view of the preferred embodiment of an inflatable sports ball according to this invention.
Figure 4:
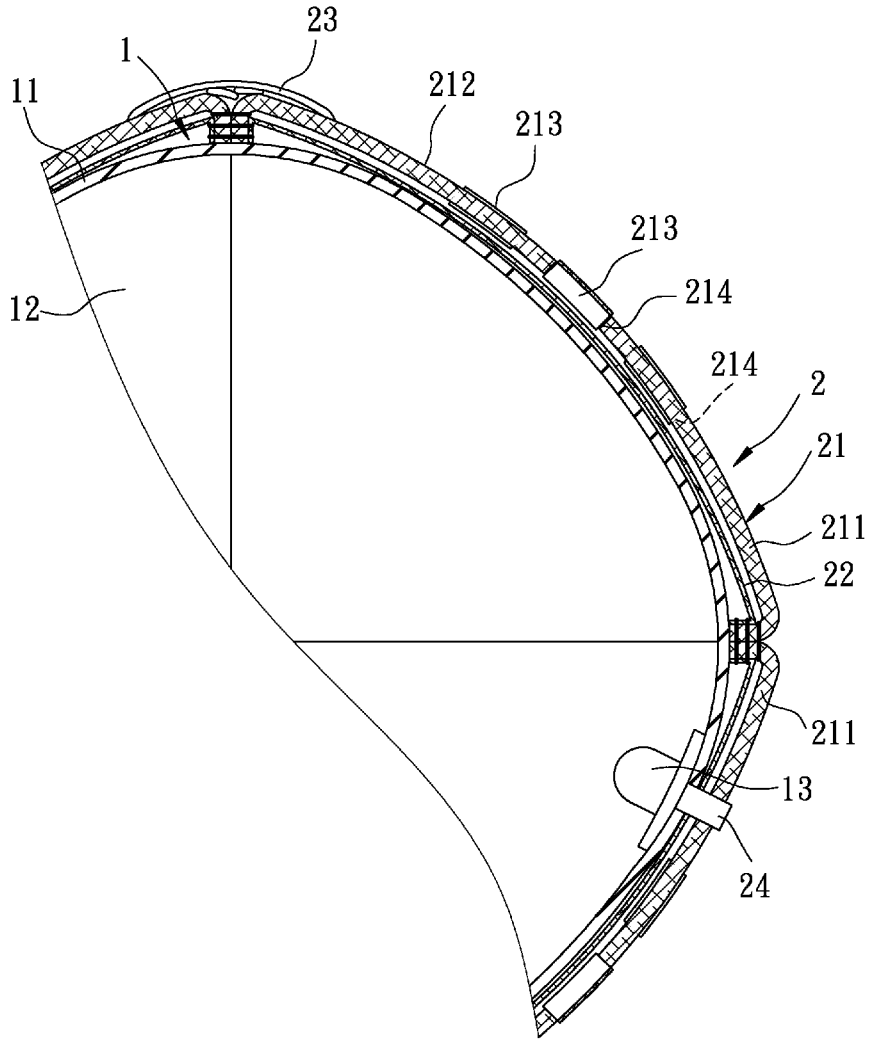
FIG. 4 is a fragmentary sectional view of the preferred embodiment.
Figure 5:
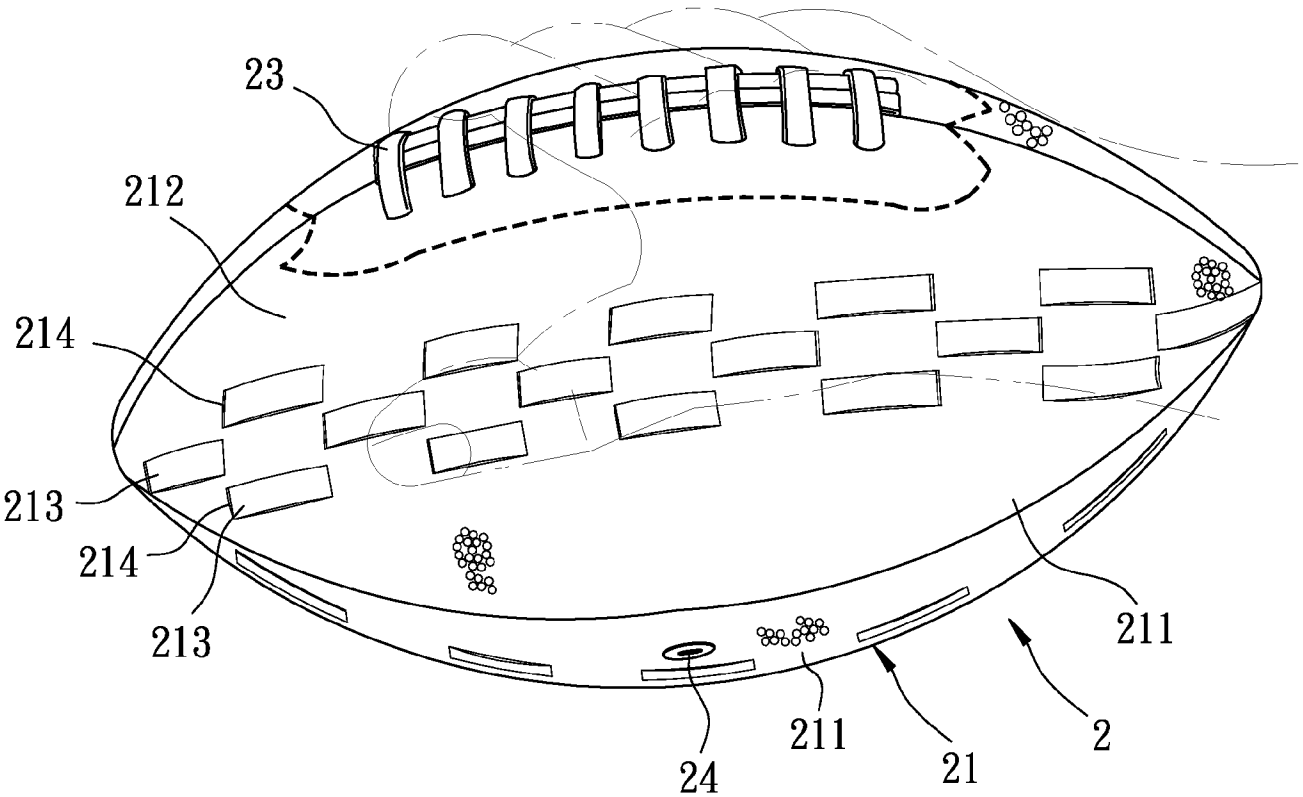
FIG. 5 is a schematic perspective view of the preferred embodiment, illustrating that the sports ball is held by a hand such that fingers are in contact with a lace unit and some fabrics of the sports ball.

Referring to FIGS. 3, 4, and 5, the preferred embodiment of an inflatable sports ball according to this invention includes an inner layer 1 and an outer layer 2.

The inner layer 1 includes a bladder 11 defining an air chamber 12, and a valve 13 mounted to the bladder 11 and in fluid communication with the air chamber 12.

The outer layer 2 includes a casing 21 surrounding the bladder 11, a position-limiting lining 22 disposed between the casing 21 and the bladder 11, a lace unit 23 disposed on an outer surface of the casing 21, and an inflation inlet 24 formed in the casing 21 and in fluid communication with the valve 13. In this embodiment, the sports ball is configured as a football. It should be noted that, the shapes of the casing 21 and the position-limiting lining 22 may be changed.

The casing 21 includes a plurality of panels 211 stitched to each other, and a plurality of fabrics 213 woven to the panels 211 and projecting from outer surfaces of the panels 211. In this embodiment, some of the fabrics 213 are located at a portion 212 of the casing 21 disposed in proximity to the lace unit 23 so that, when the sports ball is held by a hand, the fingers contact the lace unit 23 and some of the fabrics 213, as shown in FIG. 5, thereby facilitating the user to catch the sports ball steadily.

Each of the panels 211 has a plurality of slits 214 formed therethrough and spaced apart from each other. The slits 214 are arranged in rows.

Each of the fabrics 213 is in the form of a looped band, and has a portion extending through one row of the slits 124 in the corresponding panel 211 along a snake-like path and abutting against two opposite side surfaces of the corresponding panel 211.

In view of the above, the inflatable sports ball of this invention has the following advantages:

1. During manufacture, the panels 211 are first formed with the slits 214. Next, the fabrics 213 are assembled to the panels 211. Finally, the panels 211 are assembled together. As such, the sports ball is easy to be customized, is made at a low cost, and can be change in outer appearance.
2. Due to inclusion of the fabrics 213 in the panels 211, the sports ball is durable. Furthermore, since the fabrics 213 project from the outer surfaces of the panels 211, they are easy to catch during use.

it should be noted that, each of the fabrics 213 may be a nightglow colored band, or a band having a color that can be automatically varied according to a change in the surrounding temperature.

With this invention thus explained, it is apparent that numerous modifications and variations can be made without departing from the scope and spirit of this invention. It is therefore intended that this invention be limited only as indicated by the appended claims.

I claim:

1. An inflatable sports ball comprising:

an inner layer including a bladder that defines an air chamber, and a valve that is mounted to said bladder and that is in fluid communication with said air chamber; and an outer layer including a casing that surrounds said bladder, and an inflation inlet that is formed in said casing and that is in fluid communication with said valve, said casing including a plurality of panels stitched to each other, and a plurality of fabrics woven to at least one of said panels in such a manner that said fabrics project from an outer surface of said at least one of said panels;

wherein each of said panels has a plurality of slits formed therethrough and spaced apart from each other, said slits being arranged in rows, each of said fabrics having a portion extending through one row of said slits in one of said panels along a snake-like path and abutting against two opposite side surfaces of said one of said panels.

2. The inflatable sports ball as claimed in claim 1, wherein said outer layer further includes a lace unit disposed on an outer surface of said casing, some of said fabrics being disposed in proximity to said lace unit.

* * * * *